US008630560B2

(12) United States Patent
Goto

(10) Patent No.: US 8,630,560 B2
(45) Date of Patent: Jan. 14, 2014

(54) PRINTING APPARATUS

(75) Inventor: Yuji Goto, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 171 days.

(21) Appl. No.: 13/361,575

(22) Filed: Jan. 30, 2012

(65) Prior Publication Data

US 2012/0237232 A1 Sep. 20, 2012

(30) Foreign Application Priority Data

Mar. 18, 2011 (JP) ..... 2011-060249

(51) Int. Cl.
*G03G 21/00* (2006.01)
*G03G 15/00* (2006.01)

(52) U.S. Cl.
USPC ..... 399/98; 399/49

(58) Field of Classification Search
USPC ..... 399/98, 49
See application file for complete search history.

(56) References Cited

U.S. PATENT DOCUMENTS

| | | | | |
|---|---|---|---|---|
| 4,273,843 | A * | 6/1981 | Fujita et al. | 430/30 |
| 4,505,572 | A * | 3/1985 | Ashida et al. | 399/22 |
| 4,550,998 | A * | 11/1985 | Nishikawa | 118/691 |
| 4,796,065 | A * | 1/1989 | Kanbayashi | 399/60 |
| 5,270,784 | A * | 12/1993 | Nakane et al. | 399/49 |
| 5,398,099 | A * | 3/1995 | Nagamochi et al. | 399/88 |
| 5,530,530 | A * | 6/1996 | Tanaka et al. | 399/64 |
| 7,869,724 | B2 * | 1/2011 | Yamasaki et al. | 399/49 |
| 8,005,386 | B2 * | 8/2011 | Suzuki | 399/64 |
| 2007/0025748 | A1 * | 2/2007 | Ishibashi et al. | 399/49 |
| 2012/0251135 | A1 * | 10/2012 | Murayama | 399/27 |
| 2013/0221205 | A1 * | 8/2013 | Yamasaki et al. | 250/216 |

FOREIGN PATENT DOCUMENTS

| | | | |
|---|---|---|---|
| JP | H11-084802 | A | 3/1999 |
| JP | H11-194555 | A | 7/1999 |
| JP | H11-202696 | A | 7/1999 |
| JP | H11-272031 | A | 10/1999 |
| JP | 2003-307900 | A | 10/2003 |
| JP | 2010-197475 | A | 9/2010 |

* cited by examiner

*Primary Examiner* — G. M. Hyder
(74) *Attorney, Agent, or Firm* — Baker Botts L.L.P.

(57) ABSTRACT

A printing apparatus includes an image forming section which forms a toner image of the image to be printed on a recording medium; a transport belt which transports the toner image formed by the image forming section; a light-emitting section which emits a light to the transport belt; a first light-receiving section which is disposed at a position through which a regular reflection light, of the light emitted from the light-emitting section, reflected from the transport belt passes; a second light-receiving section which is disposed at a position different from the position of the first light-receiving section; a transmissive member which is disposed at a position through which the light emitted from the light-emitting section and a reflection light, of the light, reflected from the transport belt pass and which transmits the light and the reflection light.

10 Claims, 13 Drawing Sheets

PRINTING APPARATUS

CROSS REFERENCE TO RELATED APPLICATION

The present application claims priority from Japanese Patent Application No. 2011-060249, filed on Mar. 18, 2011, the disclosure of which is incorporated herein by reference in its entirety.

BACKGROUND OF THE INVENTION

1. Field of the Invention

The present invention relates to a printing apparatus as follows. That is, marks are formed by adhering toners of K (black), Y (yellow), M (magenta), and C (cyan) on a transport belt. Then, light is emitted from a light-emitting element to the marks to observe reflection lights thereof and to obtain correction data necessary for a color deviation correction and/or a density correction.

2. Description of the Related Art

There has conventionally been known a printing apparatus provided with the following mark sensor (see Japanese Patent Application Laid-open No. H11-272031). That is, the mark sensor emits light to marks formed on a transport belt to receive reflection lights thereof and detects whether positions of the formed marks are appropriate based on the reflection lights. In this printing apparatus, in some cases, toners etc. of the detection marks formed on the transport belt scatter to cause contamination of the mark sensor. Therefore, a transmissive member (contamination prevention sheet) is provided between the mark sensor and the transport belt to avoid the contamination of the mark sensor. Then, a cleaning device cleans the toners adhered to the transmissive member.

However, the printing apparatus described above does not include a configuration for detecting the contamination of the transmissive member. Thus, a problem arises such that whether or not the transmissive member is contaminated can not be judged.

In view of this, an object of the present teaching is to provide a printing apparatus which is capable of judging as to whether or not the transmissive member is contaminated.

SUMMARY OF THE INVENTION

According to an aspect of the present teaching, a printing apparatus which prints an image on a recording medium, including: an image forming section which forms a toner image of the image to be printed on the recording medium; a transport belt which transports the toner image formed by the image forming section; a light-emitting section which emits a light to the transport belt; a first light-receiving section which is disposed at a position through which a regular reflection light, of the light emitted from the light-emitting section, reflected from the transport belt passes; a second light-receiving section which is disposed at a position different from the position of the first light-receiving section; a transmissive member which is disposed at a position through which the light emitted from the light-emitting section to the transport belt and a reflection light, of the light, reflected from the transport belt pass and which transmits the light and the reflection light; and a judgment section which calculates a first ratio which is a ratio of a light-receiving amount of the first light-receiving section to a light-emitting amount of the light-emitting section and a second ratio which is a ratio of a light-receiving amount of the second light-receiving section to the light-emitting amount of the fight-emitting section, and the judgment section judges whether or not the transmissive member is contaminated based on the first ratio and the second ratio.

According to this construction, it is possible to judge whether the transmissive member is contaminated.

DESCRIPTION OF THE PREFERRED EMBODIMENTS

First Embodiment

An explanation will be made in detail with reference to the accompanying drawings about embodiments in which an image forming apparatus and an image forming system according to the present teaching are embodied. In this embodiment, the present teaching is applied to a multifunction machine (MFP: Multi Function Peripheral) having a color print function.

Construction of MFP

Figure 1:
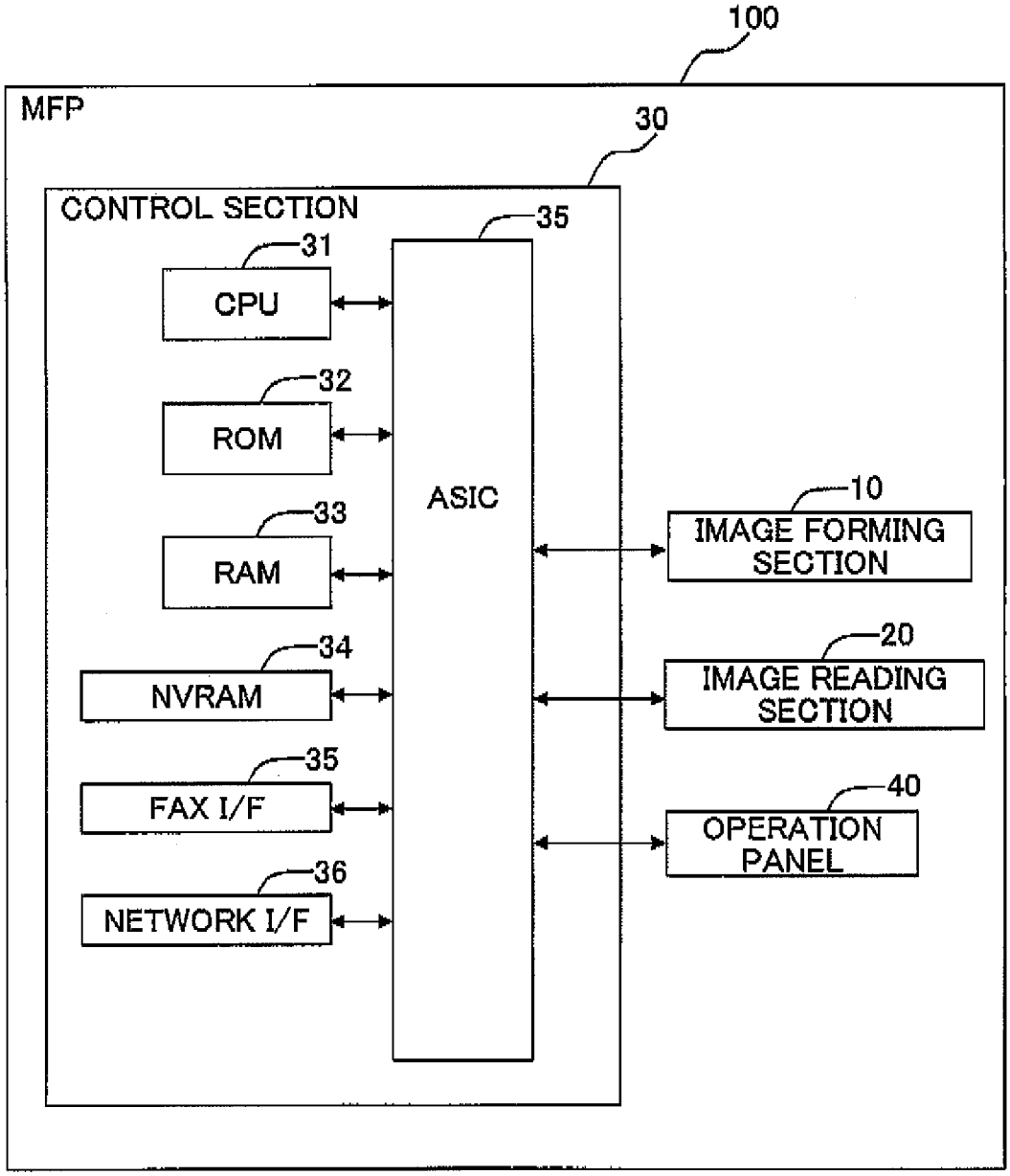
FIG. 1 is a block diagram showing an electrical construction of a multi-function peripheral (MFP).

As shown in FIG. 1, a MFP 100 of this embodiment is provided with a control section 30 including a CPU 31, a ROM 32, a RAM 33, a NVRAM (Non Volatile RAM) 34, an ASIC 35, a network interface 36, and a FAX interface 37. Further, the control section 30 is electrically connected to an image forming section 10 which forms an image on a paper sheet, an image reading section 20 which reads the image of a document, and an operation panel 40 (an example of a reporting section of the present teaching) which displays an operation state and through which a user performs an input operation.

The CPU 31 (an example of a detection section, a judgment section, and an adjustment section of the present teaching) executes calculation for realizing various functions of the MFP 100, such as an image reading function, an image forming function, a FAX data sending/receiving function, etc. The CPU 31 acts as the center of control. The ROM 32 stores various control programs, various settings for controlling the MFP 100, and an initial value, etc. The RAM 33 is utilized as a work area at which the various control programs are read or as a storage area which temporarily stores image data. The NVRAM 34 is a storage means having nonvolatility and is utilized as the storage area which stores the various settings, the image data, a print history which is a history of a type of printing, such as a monochrome (black and white) printing, a color printing, etc., the number of paper sheets printed on which the image is formed by the image forming section 10, and a history of a light-emitting amount which is a history of PWM level as will be described later on, and the like.

The CPU 31 controls each component of the MFP 100 (for example, a timing of lighting of an exposure device constructing the image forming section 10, a drive motor of various rollers constructing the transport route of the paper sheet) via the ASIC 35, while storing, in the RAM 33 or the NVRAM 34, a processing result processed in accordance with the control program read from the ROM 32 and/or a signal from each of the sensors.

The network interface 36 is connected to a network thereby making it possible to connect the MFP 100 with another information process apparatus. The FAX interface 37 is connected to a telephone line thereby making it possible to connect the MFP 100 with a FAX apparatus of the other party. Thus, it is possible to perform a data communication between the MFP 100 and an external apparatus via the network interface 36 and/or the FAX interface 37.

Construction of Image Forming Section of MFP

Subsequently, a construction of the image forming section 10 (an example of an image forming section of the present teaching) of the MFP 100 will be explained with reference to FIG. 2. The image forming section 10 is provided with a process section 50 which forms a toner image in accordance with a well-known electro-photographic manner and then transfers the toner image on the paper sheet; a fixing device 8 fixing the toner which is not yet fixed on the paper sheet; a paper feed tray 91 on which paper sheets to be printed are placed; and a paper discharge tray 92 on which the paper sheets that have been printed are placed. The image reading section 20 is disposed over or above the image forming section 10.

Further, the image forming section 10 is provided with an exposure device 53 which emits a laser light to the process sections 50Y, 50M, 50C, 50K, a transport belt 7 (an example of a transport belt of the present teaching) which transports the paper sheet to the transfer positions of the process sections 50Y, 50M, 50C, 50K, and a mark sensor 61 which detects marks formed on the transport belt 7.

Further, in the image forming section 10, a substantially S-shaped transport route 11 (alternate long and short dash lines in FIG. 2) is provided so that the paper sheets accommodated in the paper feed tray 91 placed on the bottom portion are successively introduced to the paper discharge tray 92 placed on the upper portion via paper discharge rollers 76 upon passing through a paper feeding roller 71, resist rollers 72, the process section 50, and the fixing device 8.

The process section 50 is capable of forming the color image and arranges, in parallel, the process sections corresponding to the respective colors of cyan (C), magenta (M), yellow (Y), black (K). In particular, the process section 50 is provided with the process section 50C forming the image of C color, the process section 50M forming the image of M color, the process section 50Y forming the image of Y color, and the process section 50K forming the image of K color.

Figure 3:
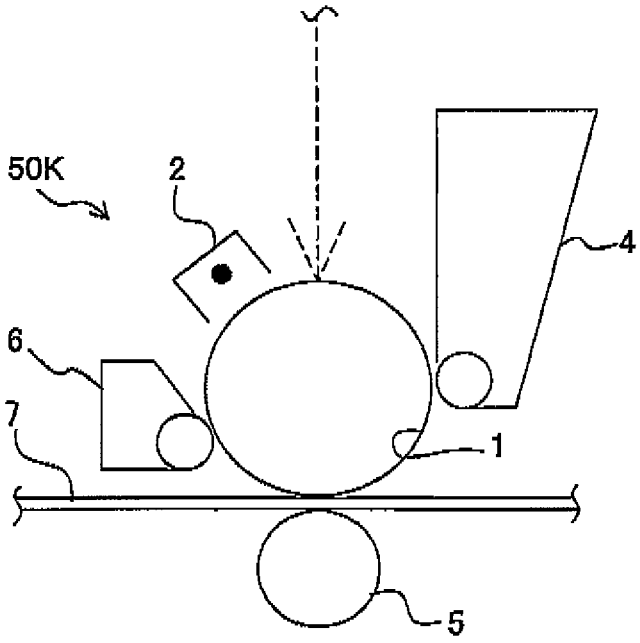
FIG. 3 schematically shows a construction of a process section of the MFP shown in FIG. 2.

FIG. 3 shows a construction of the process section 50K. The process section 50K includes a drum-shaped photosensitive member 1, a charging device 2 which charges a surface of the photosensitive member 1 uniformly, a development unit 4 which performs development with respect to an electrostatic latent image by the toner, a transfer unit 5 which transfers the toner image on the photosensitive member 1 onto the paper sheet, and a cleaner 6 which electrically traps, from the surface of the photosensitive member 1, the toner which has remained on the photosensitive member 1 after the transfer (transfer residue toner). Each of the process sections 50C, 50M, 50Y has the same construction as the process section 50K.

In each of the process sections 50C, 50M, 50Y, 50K, the surface of the photosensitive member 1 is uniformly charged by the charging device 2. Then, the surface of the photosensitive member 1 is exposed with light from the exposure device 53 to form the electrostatic latent image of the image to be formed on the paper sheet. Subsequently, the toner is supplied on the photosensitive member 1 via the development unit 4. By doing so, the electrostatic latent image on the photosensitive member 1 is converted into a visual image as the toner image.

The image forming section 10 takes the paper sheets placed on the paper feed tray 91 one-by-one and transports the paper sheet onto the transport belt 7. Then, the toner image formed at the process section 50 is transferred onto the paper sheet. In this situation, when the color printing is performed, the toner images are formed at the process sections 50C, 50M, 50Y, 50K and each of the toner images is overlapped on the paper sheet. On the other hand, when the monochrome printing is performed, the toner image is formed at the process section 50K only and is transferred onto the paper sheet. Then, the paper sheet on which the toner image is transferred is transported to the fixing device 8 and the toner image is thermally fixed on the paper sheet. The paper sheet on which the toner image is fixed is discharged on the paper discharge tray 92.

The transport belt 7 is an endless belt member suspended between the transport rollers 73, 74 and is made of a resin material such as polycarbonate.

The transport roller 74 is a driving roller which is rotationally driven by the drive motor 75. When the transport roller 74 is rotationally driven, the transport belt 7 is moved in a circulating manner in a counterclockwise direction in the paper surface of FIG. 2. The transport roller 73 is rotated in accordance with the movement of the transport belt 7.

The mark sensor 61 detects the marks formed by the process sections 50C, 50M, 50Y, 50K on the transport belt 7.

A transmissive member 65 (an example of a transmissive member of the present teaching) (see FIG. 4) is made of a transparent resin. The transmissive member 65 has a property that light to be detected by the mark sensor 61 is allowed to transmit. Further, the transmissive member 65 avoids contamination of the mark sensor 61 caused by the toner scattering from the mark 66 (see FIG. 4) etc. formed on the transport belt 7.

Figure 4:
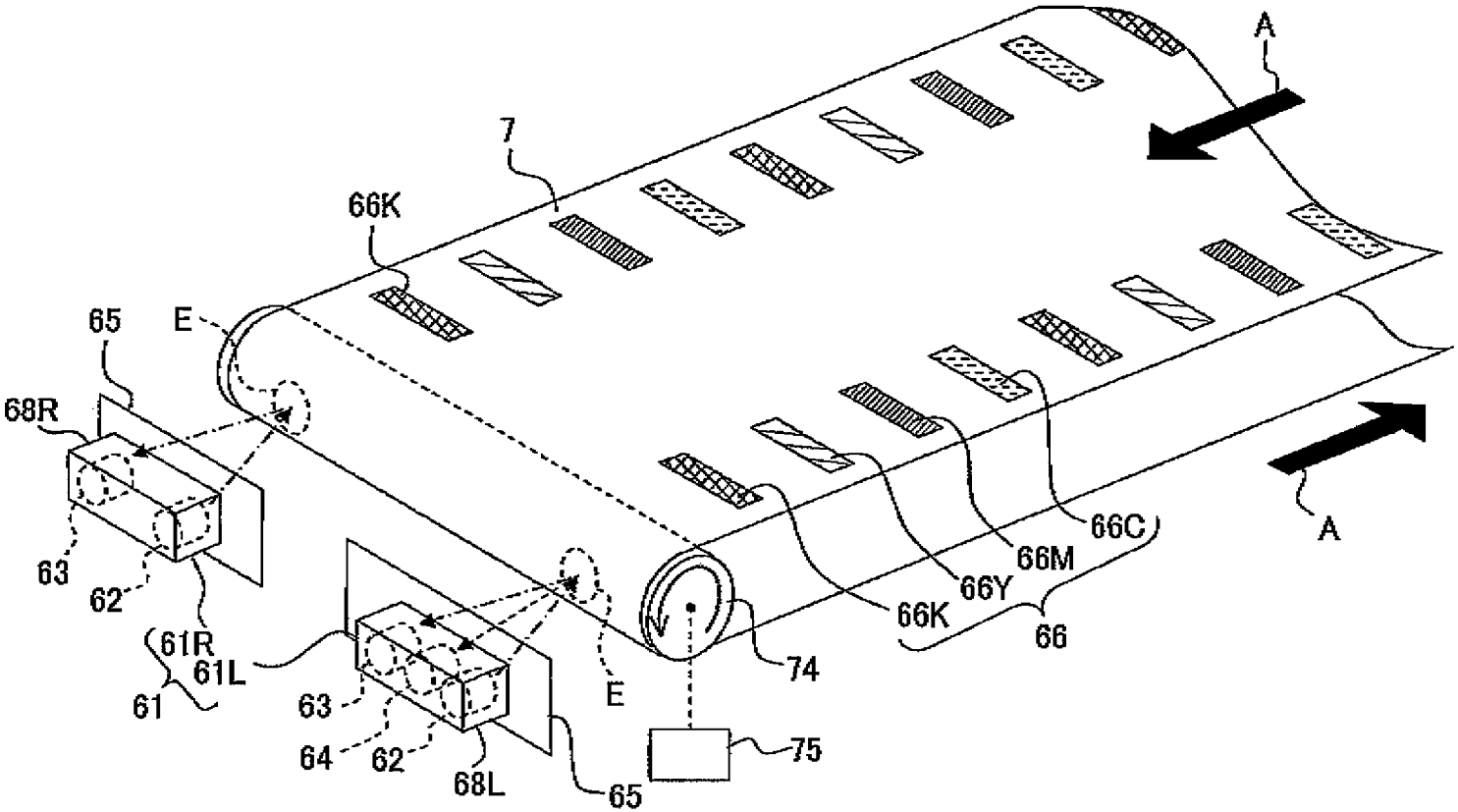
FIG. 4 is a diagram showing an arrangement of a mark sensor and an example of detection marks.

In particular, as shown in FIG. 4, the mark sensor 61 is formed by two sensors including a sensor 61R arranged at a right side in a width direction of the transport belt 7 and a sensor 61L arranged at a left side. The sensor 61R is a reflection type optical sensor in which a light-emitting element 62 (an example of a light-emitting section of the present teaching), such as LED, and a regular reflection light-receiving element 63 (an example of a first light-receiving section) for receiving the regular reflection light, such as a phototransistor, make a set. The sensor 61R has a holder 68R which holds the light-emitting element 62 and the regular reflection light-receiving element 63 and which prevents stray light from entering the sensor 61R. On the other hand, the sensor 61L is the reflection type optical sensor in which the light-emitting element 62, the regular reflection light-receiving element 63 for receiving the regular reflection light, and a diffused reflection light-receiving element 64 (an example of a second light-receiving section of the present teaching) for receiving the diffused reflection light make a set. The sensor 61L also has a holder 68L which holds the light-emitting element 62, the regular reflection light-receiving element 63, and the diffused reflection light-receiving element 64 and which prevents stray light from entering the sensor 61L. The mark sensor 61 is configured as follows. That is, the light is emitted from the light-emitting element 62 to a dotted frame E on the surface of the transport belt 7 in an oblique direction, and reflection light thereof is received by the regular reflection light-receiving element 63 and the diffused reflection light-receiving element 64. Further, the regular reflection light-receiving element 63 is provided to position on an optical path through which the regular reflection light passes, the regular reflection light being a light in which the light emitted from the light-emitting element 62 is regularly reflected by the transport belt 7 when there is nothing on the surface of the transport belt 7. Each of the regular reflection light-receiving element 63 and the diffused reflection light-receiving element 64 outputs voltage proportional to a light-receiving amount as a detecting result. The CPU 31 is capable of knowing the respective light amounts received by the regular reflection light-receiving element 63 and the diffused reflection light-receiving element 64 by measuring the output voltage from the regular reflection light-receiving element 63 and the output voltage from the diffused reflection light-receiving element 64.

Here, the regular reflection light refers to a light in which an incident angle of the light which is emitted from the light-emitting element 62 to the dotted frame E on the surface of the transport belt 7 in the oblique direction and a reflection angle of the reflection light which is reflected at the dotted frame E on the surface of the transport belt 7 are substantially equal; and which is received by the regular reflection light-receiving element 63 of the light reflected at the dotted frame E on the surface of the transport belt 7. Further, the diffused reflection light refers to the reflection light, other than the regular reflection light, in which the incident angle of the light which is emitted from the light-emitting element 62 to the dotted frame E on the surface of the transport belt 7 in the oblique direction and the reflection angle of the light which is reflected at the dotted frame E on the surface of the transport belt 7 are different from each other.

Here, when the transmissive member 65 is not contaminated, if the transport belt 7 does not deteriorate and is not contaminated by the toner etc., the light emitted from the light-emitting element 62 to the surface of the transport belt 7 is regularly reflected at the surface of the transport belt 7. On the other hand, when the transport belt 7 deteriorates or is contaminated by the toner etc., a part of the light emitted from the light-emitting element 62 to the surface of the transport belt 7 is regularly reflected at the surface of the transport belt 7, but a remaining part of the light is diffusely reflected due to the damage and/or the contamination of the surface of the transport belt 7.

The mark 66 (an example of a mark of the present teaching) is formed by each of the process sections 50C, 50M, 50Y, 50K and is transferred on the transport belt 7. Then, the transport belt 7 is moved in the circulating manner to transport the mark 66 in a direction shown by the arrow A of FIG. 4. The mark sensor 61 detects a position and/or density of the mark depending on the difference between the light-receiving amount when the mark 66 passes and the light-receiving amount reflected directly from the transport belt 7. Then, the detection results are utilized in correction of the position and/or the density at the time of forming the image (hereinafter also referred to as a correction process).

The marks 66K, 66C, 66M, 66Y are formed while providing constant spacing distances in a subsidiary scanning direction (moving direction of the transport belt 7 shown in FIG. 4) so that the marks are not overlapped with one another when the marks are transferred on the transport belt 7.

Each of the marks 66K, 66C, 66M, 66Y of this embodiment is in the shape of a rectangular rod. The respective marks are arranged parallel in each other in a main scanning direction (a direction perpendicular to the subsidiary scanning direction, width direction of the transport belt 7).

Figure 2:
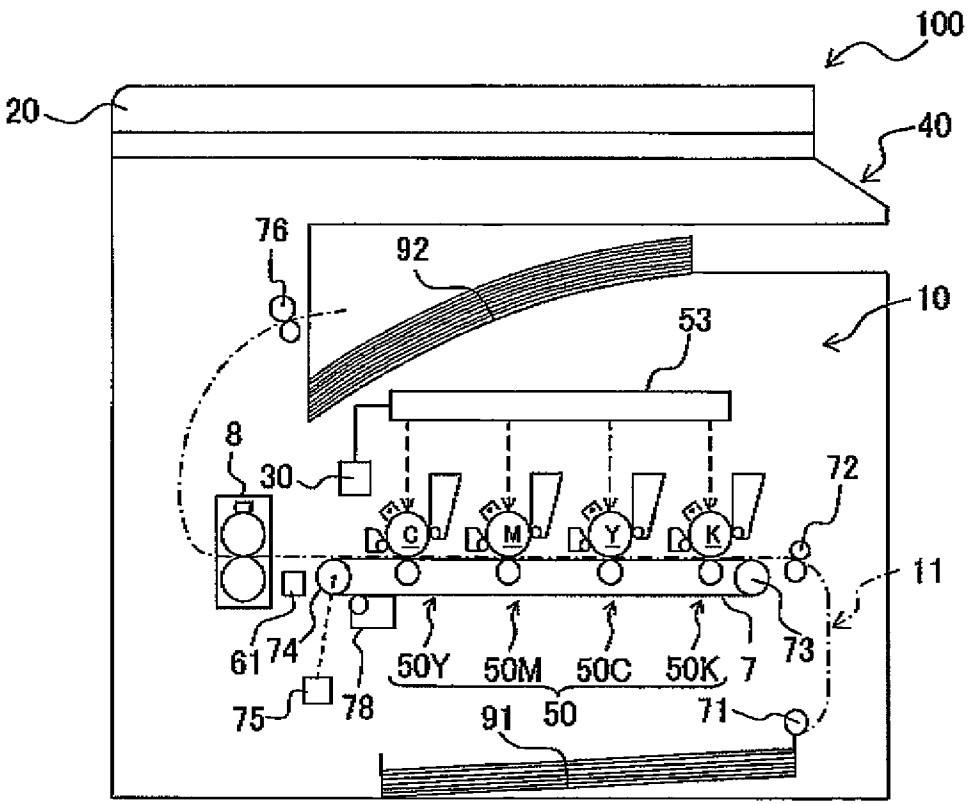
FIG. 2 schematically shows a construction of an image forming section of the MFP shown in FIG. 1.

Further, as shown in FIG. 2, a waste toner box 78 (an example of a cleaning section of the present teaching) which recovers the toner etc. adhered on the transport belt 7 is disposed on the transport belt 7 in a state that the waste toner box 78 is brought in contact with the transport belt 7. The waste toner box 78 mainly recovers the mark 66 formed on the transport belt 7, paper powder, and the like.

Light-Emitting Amount Adjustment Process

A light-emitting amount adjustment process refers to the following process. That is, the CPU 31 increases or decreases the light-emitting amount emitted from the light-emitting element 62 to adjust the light-emitting amount of the light-emitting element 62 so that the output voltage from the regular reflection light-receiving element 63, that is, the output voltage corresponding to the light-receiving amount received by the regular reflection light-receiving element 63 becomes constant. Here, the light-emitting element 62 emits the light ranging from 0 to 255 stage levels (the higher the numerical value is, the larger the light-emitting amount is) defined by a pulse width of PWM (Pulse Width Modulation) generated by the CPU 31. Therefore, the light-emitting amount emitted from the light-emitting element 62 will be explained below while appropriately using the pulse width of the PWM (0 to 255 stage levels). For example, when the light-emitting amount of the light-emitting element 62 is the maximum light-emitting amount, that is, the pulse width of the PWM is in the 255 stage level, the light-emitting amount of the light-emitting element 62 will be explained by using the wording "PWM level 255". Further, the regular reflection light-receiving element 63 and the diffused reflection light-receiving element 64 are elements outputting the voltages corresponding to the lights received by the regular reflection light-receiving element 63 and the diffused reflection light-receiving element 64. Thus, it is possible to specify the light-receiving amounts received by the respective light-receiving elements based on the voltage values outputted from the regular reflection light-receiving element 63 and the diffused reflection light-receiving element 64. Accordingly, in the following explanation, the light-receiving amount received by each light-receiving element will be explained as follows. That is, the light-receiving amount received by each light-receiving element is appropriately replaced with a value of the output voltage (unit is V (volt)) outputted from each light-receiving element.

Further, the following explanation will be made on the assumption that when a new transport belt 7 is used and when the light-emitting element 62 emits the light at PWM level 100, the regular reflection light-receiving element 63 outputs the voltage of 4.0 V by the light reflected from the transport belt 7.

If the transport belt 7 is used for a long time, in some cases, the surface of the transport belt 7 is damaged (deteriorates) or the contamination, such as the paper powder etc., is strongly adhered on the surface of the transport belt 7, so that the contamination can not be removed completely by the cleaning with a cleaning unit 78. As a result, the regular reflection light amount from the transport belt 7 gradually decreases. Thus, the following situation may arise. That is, when the light is emitted from the light-emitting element 62 to the transport belt 7 in the light-emitting amount corresponding to the PWM level 100 and when the new transport belt 7 is used the voltage outputted from the regular reflection light-receiving element 63 by receiving the reflection light from the transport belt 7 is 4.0 V. However, when the transport belt 7 is used for a long time, said voltage becomes lower than 4.0 V, for example, 3.5 V or 3.0 V.

It is also considered that the output voltage corresponding to the light-receiving amount of the regular reflection light-receiving element 63 decreases because the light-emitting amount decreases due to the deterioration of the light-emitting element 62. However, the decrement thereof is sufficiently small as compared with the decrement caused when the transport belt 7 is used for a long time as described above. Therefore, it is possible to ignore any effect caused when the light-emitting amount decreases due to the deterioration of the light-emitting element 62.

In view of this, the CPU 31 performs the light-emitting amount adjustment process of the light-emitting element 62 such that the output voltage from the regular reflection light-receiving element 63 becomes 4.0 V by increasing the PWM level from the PWM level 100 to PWM level 120 or PWM level 140. By doing so, even if the deterioration of the surface of the transport belt 7 and/or the contamination, such as the paper powder etc., arise(s) due to the long period of use of the transport belt 7, the output voltage from the regular reflection light-receiving element 63 is adjusted to be a fixed value (for example, 4.0 V, an example of a fixed value of the present teaching).

Figure 5:
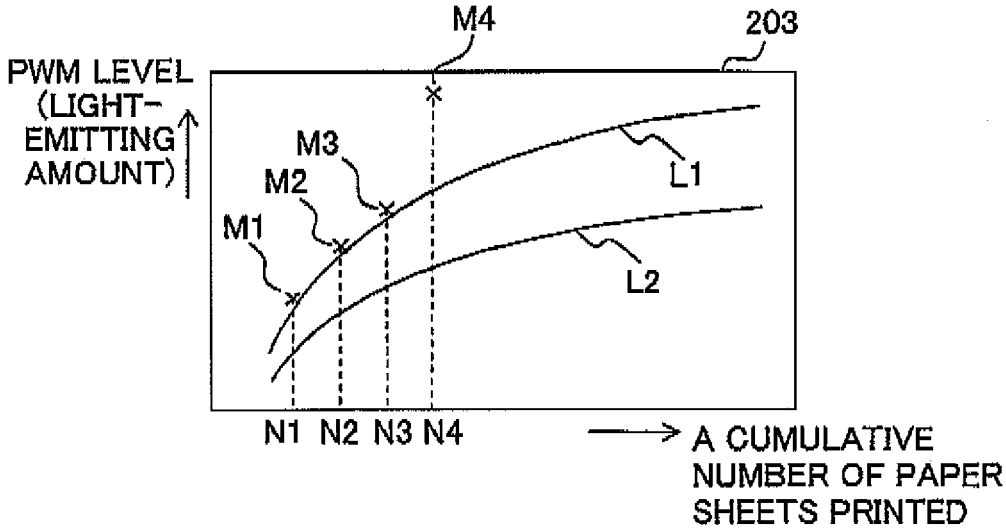
FIG. 5 is a diagram showing an example of relation between the number of paper sheets printed and a light-emitting amount for obtaining a predetermined light-receiving amount.

Here, a relation between the PWM level (light-emitting amount) of the light-emitting element 62 in which the output voltage from the regular reflection light-receiving element 63 is 4.0 V and a cumulative number of paper sheets printed in the transport belt 7 attached to the MFP 100 is shown by a durability curve L1 in FIG. 5 which is obtained from an experimental result. A light-emitting amount secular change table based on the durability curve L1 is previously stored in the NVRAM 34 of the MFP 100.

Method for Detecting Contamination of Transmissive Member

Next, a method for detecting the contamination of the transmissive member in which the contamination of the transmissive member 65 is detected by using the mark sensor 61L will be explained with reference to FIG. 6 to FIG. 9.

Figure 6:
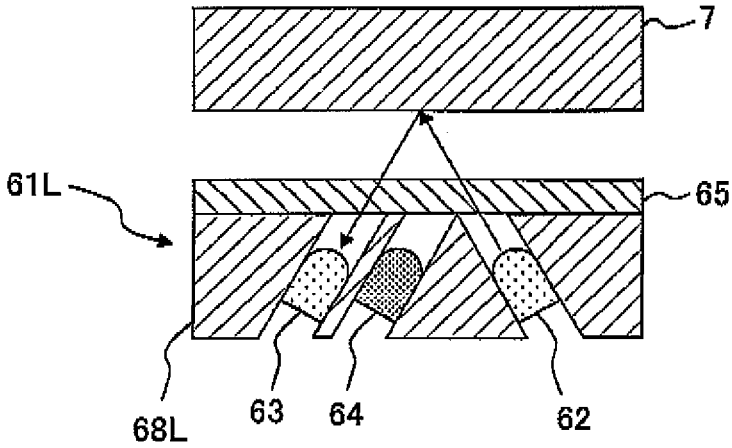
FIG. 6 shows an outline of light emission and light reception of the mark sensor in a case that a transmissive member is not contaminated.

At first, an explanation will be made about a case in which neither the transport belt 7 nor the transmissive member 65 has the contamination, with reference to FIG. 6. The CPU 31 controls the light-emitting element 62 to emit the light to the dotted frame E on the surface of the transport belt 7 in the oblique direction, and the reflection light thereof is received by the regular reflection light-receiving element 63 and the diffused reflection light-receiving element 64. In this situation, almost all of the light emitted from the light-emitting element 62 to the transport belt 7 is regularly reflected, and the diffused reflection hardly occurs. Thus, a substantial portion of the reflection light is received by the regular reflection light-receiving element 63 and the diffused reflection light-receiving element 64 hardly receives the reflection light. When neither the transport belt 7 nor the transmissive member 65 has the contamination, the output voltage from the regular reflection light-receiving element 63 is approximately 4.0 V, and the output voltage from the diffused reflection light-receiving element 64 is approximately 0 V.

Figure 7A:
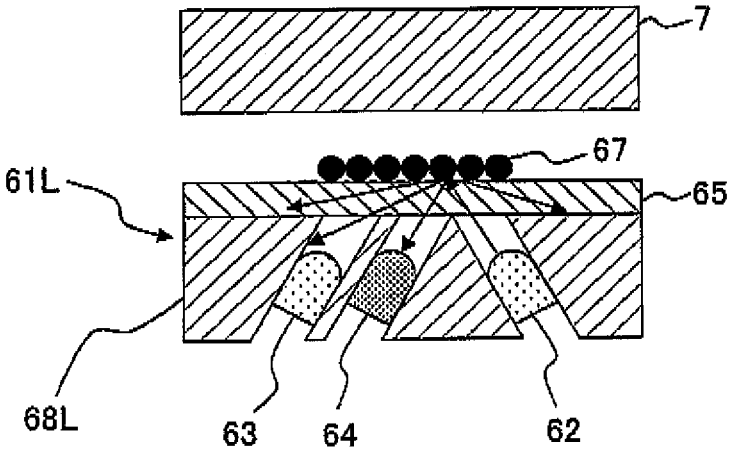
FIG. 7A shows an outline of the light emission and the light reception of the mark sensor in a case that the transmissive member is contaminated.

Next, an explanation will be made about a case, in which the transport belt 7 has no contamination but the transmissive member 65 has the contamination, with reference to FIG. 7A. In this case, the light emitted from the light-emitting element 62 is diffusely reflected due to a contamination 67 on the transmissive member 65. Thus, the light-receiving amount of the regular reflection light-receiving element 63 is smaller than the light-receiving amount of the regular reflection light-receiving element 63 when neither the transport belt 7 nor the transmissive member 65 has the contamination. Therefore, the output voltage from the regular reflection light-receiving element 63 is smaller than the output voltage from the regular reflection light-receiving element 63 when neither the transport belt 7 nor the transmissive member 65 has the contamination.

On the other hand, when the transmissive member 65 has the contamination 67, the light emitted from the light-emitting element 62 to the transport belt 7 is diffusely reflected due to the contamination 67 on the transmissive member 65. Therefore, the diffused reflection light-receiving element 64 receives the light diffusely reflected by the contamination 67. In other words, the light-receiving amount of the diffused reflection light-receiving element 64 is larger than the light-receiving amount of the diffused reflection light-receiving element 64 when neither the transport belt 7 nor the transmissive member 65 has the contamination. Therefore, the output voltage from the diffused reflection light-receiving element 64 becomes larger than the output voltage from the diffused reflection light-receiving element 64 when neither the transport belt 7 nor the transmissive member 65 has the contamination (for example, 1.0 V or 2.0 V).

Accordingly, when the light-receiving amount (output voltage) of the regular reflection light-receiving element 63 is smaller than the light-receiving amount (output voltage) of the regular reflection light-receiving element 63 when neither the transport belt 7 nor the transmissive member 65 has the contamination, and when the light-receiving amount (output voltage) of the diffused reflection light-receiving element 64 is larger than the light-receiving amount (output voltage) of the diffused reflection light-receiving element 64 when neither the transport belt 7 nor the transmissive member 65 has the contamination, the transmissive member 65 is likely to have the contamination 67 and the transmissive member 65 can be regarded as to have the contamination.

Figure 7B:
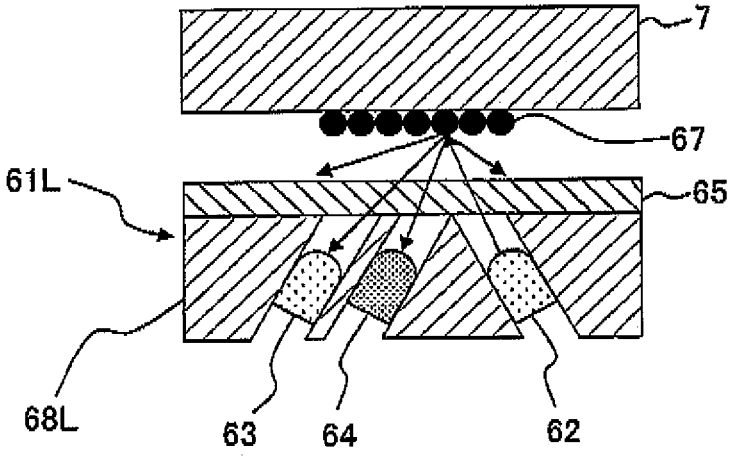
FIG. 7B shows an outline of the light emission and the light reception of the mark sensor in a case that a transport belt is contaminated.

Next, an explanation will be made about a case in which the transport belt 7 has the contamination but the transmissive member 65 has no contamination, with reference to FIG. 7B. Even when the transmissive member 65 has no contamination, when the transport belt 7 has the contamination 67 due to the toners of C color, M color, and Y color, the light emitted from the light-emitting element 62 to the transport belt 7 is diffusely reflected due to the contamination 67 on the transport belt 7. Therefore, the light-receiving amount (output voltage) of the regular reflection light-receiving element 63 is smaller than the light-receiving amount (output voltage) of the regular reflection light-receiving element 63 when neither the transport belt 7 nor the transmissive member 65 has the contamination 67. The light-receiving amount (output voltage) of the diffused reflection light-receiving element 64 is larger than the light-receiving amount (output voltage) of the diffused reflection light-receiving element 64 when neither the transport belt 7 nor the transmissive member 65 has the contamination 67. That is, in the contamination detection of the transmissive member described above, the light-receiving amount (output voltage) of the regular reflection light-receiving element 63 is small and the light-receiving amount (output voltage) of the diffused reflection light-receiving element 64 is large, even when only the transmissive member 65 is contaminated (see FIG. 7A) and even when only the transport belt 7 is contaminated (see FIG. 7B). Thus, the contamination of the transmissive member 65 and the contamination of the transport belt 7 can not be distinguished from each other. Therefore, the contamination detection of the transmissive member described above is preferably performed in a state that a condition for reducing the diffused reflection light from the transport belt 7 as much as possible is satisfied. The above contamination detection is preferably performed in a state that the toners of C, M, Y causing the diffused reflection are not adhered on the transport belt 7, for example, immediately after the transport belt 7 is cleaned by the cleaning unit 78. It is noted that, the toner of K has the property to hardly reflect the light emitted from the light-emitting element 62. Thus, even if the toner of K is adhered on the surface of the transport belt 7, the light emitted from the light-emitting element 62 to the transport belt 7 is hardly diffusely reflected. Therefore, if the toner of K is adhered on the transport belt 7, the effect on the contamination detection of the transmissive member described above is small.

Figure 8:
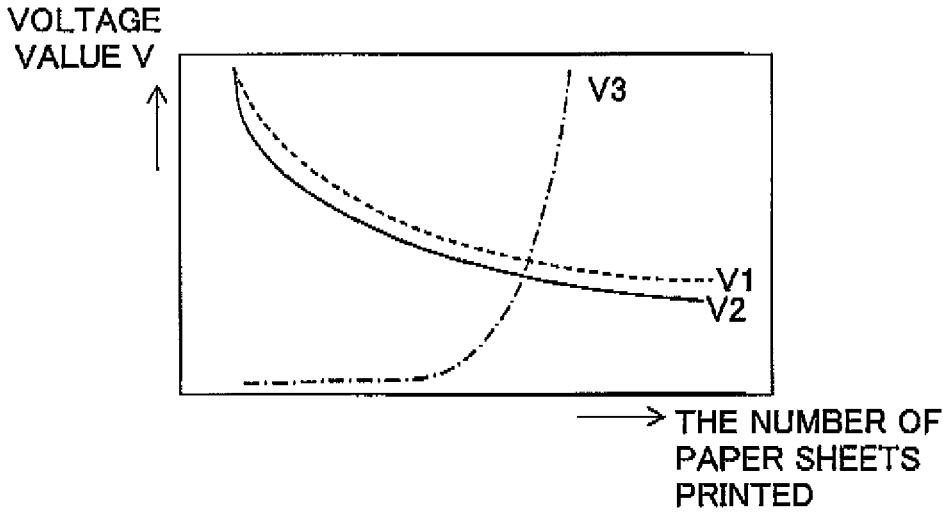
FIG. 8 is a diagram showing an example of a relation between the number of paper sheets printed and the light-receiving amount of a regular reflection light; and a relation between the number of paper sheets printed and the light-receiving amount of a diffused reflection light.

Next, an explanation will be made about a relation between the number of paper sheets printed by the MFP 100 and the output voltage value corresponding to the light-receiving amount of the regular reflection light received by the regular reflection light-receiving element 63; and a relation between the number of paper sheets printed by the MFP 100 and the output voltage value corresponding to the light-receiving amount of the diffused reflection light received by the diffused reflection light-receiving element 64, with reference to FIG. 8. It is noted that each curve shown in FIG. 8 shows an example in which the PWM level is not adjusted after once the PWM level is adjusted so that the light-receiving amount of the regular reflection light-receiving element 63 becomes 4.0 V.

A curve V1 is a curve showing the voltage value corresponding to the light-receiving amount of the regular reflection light received by the regular reflection light-receiving element 63 when the contamination, such as the paper powder etc., is adhered on the surface of the transport belt 7 and when the transmissive member 65 is not contaminated by the toners of C color, M color, and Y color. The curve V1 shows that even if the transmissive member 65 is not contaminated, the contamination, such as the paper powder etc., is adhered on the surface of the transport belt 7 due to the increase in the number of paper sheets printed and the long period of use of the transport belt 7, and thus the light-receiving amount of the regular reflection light-receiving element 63 gradually decreases.

A curve V2 is a curve showing a change of the voltage value corresponding to the light-receiving amount of the regular reflection light received by the regular reflection light-receiving element 63 when there is little contamination, such as the paper powder etc., on the surface of the transport belt 7 and when the transmissive member 65 is contaminated by the toners of C color, M color, and Y color. The curve V2 shows that when the number of paper sheets printed increases and thereby the contamination 67 due to the toners of C color, M color, and Y color is accumulated on the transmissive member 65, the light-receiving amount of the regular reflection light-receiving element 63 gradually decreases. The curve V2 shows that the curve V1 and the curve V2 have similar tendencies.

A curve V3 is a curve showing a change of the voltage value corresponding to the light-receiving amount of the diffused reflection light received by the diffused reflection light-receiving element 63 when there is little contamination, such as the paper powder etc., on the surface of the transport belt 7 and when the transmissive member 65 is contaminated by the toners of C color, M color, and Y color. The curve V3 shows that when the number of paper sheets printed is small and there is little contamination 67 on the transmissive member 65, since the light is hardly reflected by the toners of C color, M color, and Y color, the output voltage corresponding to the light-receiving amount of the diffused reflection light-receiving element 64 is substantially equal to 0 V. Further, the curve V3 shows that when the number of paper sheets printed increases and thereby the contamination 67 due to the toners of C color, M color, and Y color is accumulated on the transmissive member 65, the light emitted from the light-emitting element 62 is diffusely reflected by the toners of C color, M color, and Y color, and the voltage value corresponding to the light-receiving amount of the diffused reflection light-receiving element 64 gradually increases.

Accordingly, it is possible to detect whether or not the transmissive member 65 is contaminated due to the toners of C color, M color, and Y color by using the difference between the change of the curve V2 and the change of the curve V3.

Figure 9:
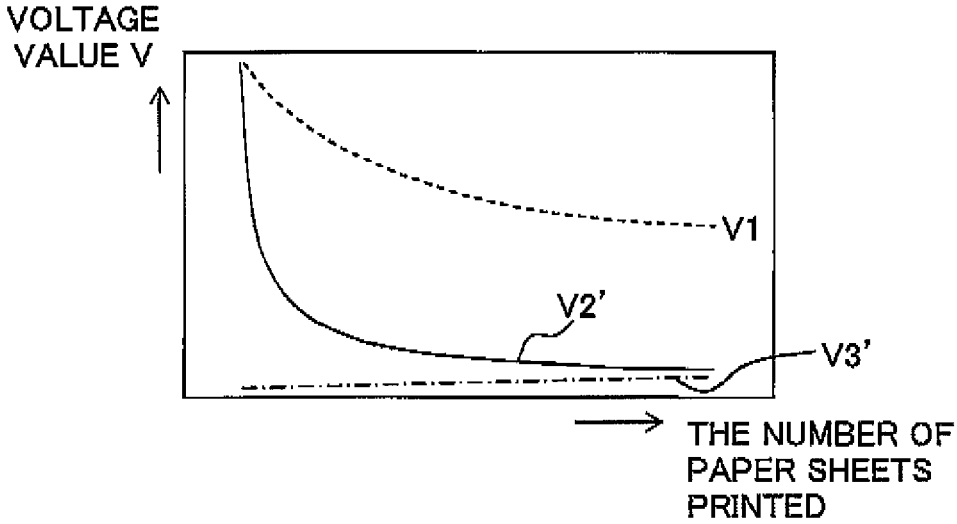
FIG. 9 is a diagram showing an example of the relation between the number of paper sheets printed and the light-receiving amount of the regular reflection light; and relation between the number of paper sheets printed and the light-receiving amount of the diffused reflection light.

Next, an explanation will be made about a relation between the cumulative number of paper sheets printed in the transport belt 7 attached to the MFP 100 and the voltage value corresponding to the light-receiving amount of the regular reflection light received by the regular reflection light-receiving element 63; and a relation between the cumulative number of paper sheets printed in the transport belt 7 attached to the MFP 100 and the voltage value corresponding to the light-receiving amount of the diffused reflection light received by the diffused reflection light-receiving element 64, with reference to FIG. 9. It is noted that the curve V1 is the same as that shown in FIG. 8; a curve V2' corresponds to the curve V2 shown in FIG. 8; and a curve V3' corresponds to the curve V3 shown in FIG. 8.

The curve V2' shows that when the number of paper sheets printed increases and thereby the contamination 67 due to the toner of K color is accumulated on the transmissive member 65, the light-receiving amount of the regular reflection light-receiving element 63 decreases. The decrement of the voltage value of the curve V2' is larger than that of the curve V2 in FIG. 8 in which the transmissive member 65 is contaminated due to the toners of C color, M color, and Y color. The reason thereof is as follows. That is, the toner of K color adhering on the transmissive member 65 absorbs the light emitted from the light-emitting element 62, and the light which reaches the transport belt 7 decreases. As a result, the amount of the regular reflection light reflected by the transport belt 7 decreases.

The curve V3' shows the light-receiving amount of the diffused reflection light-receiving element 64. Further, the curve V3' shows as follows. That is, when the number of paper sheets printed is small and when there is little contamination on the transmissive member 65, the output voltage corresponding to the light-receiving amount of the diffused reflection light-receiving element 64 is substantially equal to 0 V as is the case in FIG. 8. However, even when the number of paper sheets printed increases and even when the contamination 67 due to the toner of K color is accumulated on the transmissive member 65, since the toner of K color adhering on the transmissive member 65 absorbs the light emitted from the light-emitting element 62, the diffused reflection hardly occurs and the light-receiving amount of the diffused reflection light does not increase.

Accordingly, when the transmissive member 65 is contaminated by the toner of K color, it is judged that the transmissive member 65 is contaminated by the toner of K color by using the property that the toner of K color absorbs the light emitted from the light-emitting element 62 (the diffused reflection and the regular reflection hardly occur). For example, the following judgment is allowable. That is, in the light-emitting amount adjustment process, when the PWM level is increased so that the light-receiving amount of the regular reflection light-receiving element 63 becomes the fixed value, and when the PWM level reaches a maximum acceptable value, it is judged that the PWM level is unadjustable. Based on this judgment, it is judged that the transmissive member 65 is contaminated by the toner of K color.

First Contamination Detection Process

Figure 10A:
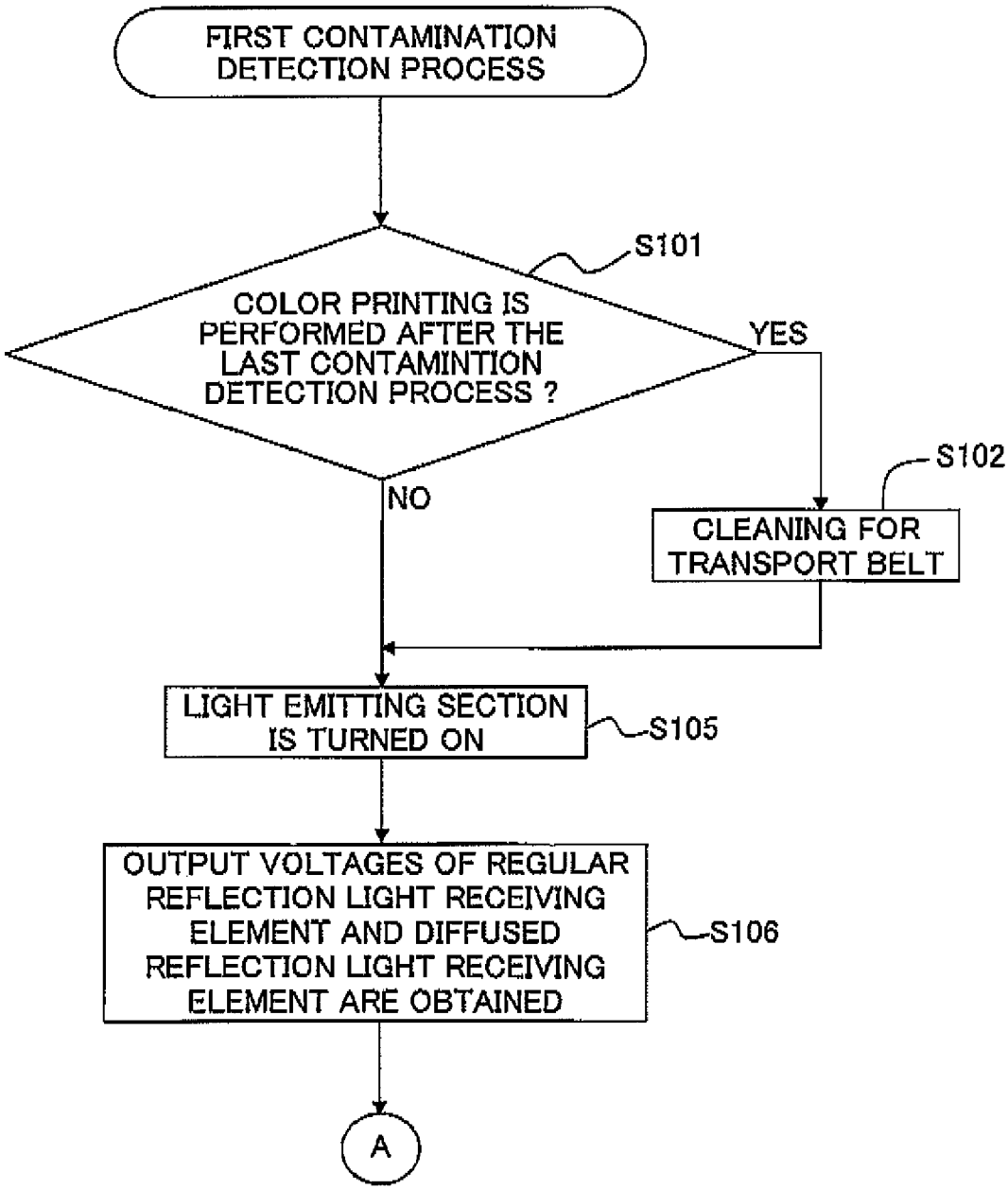
FIGS. 10A and 10B show a flowchart showing the first contamination detection process according to the first embodiment of the present teaching.
Figure 10B:
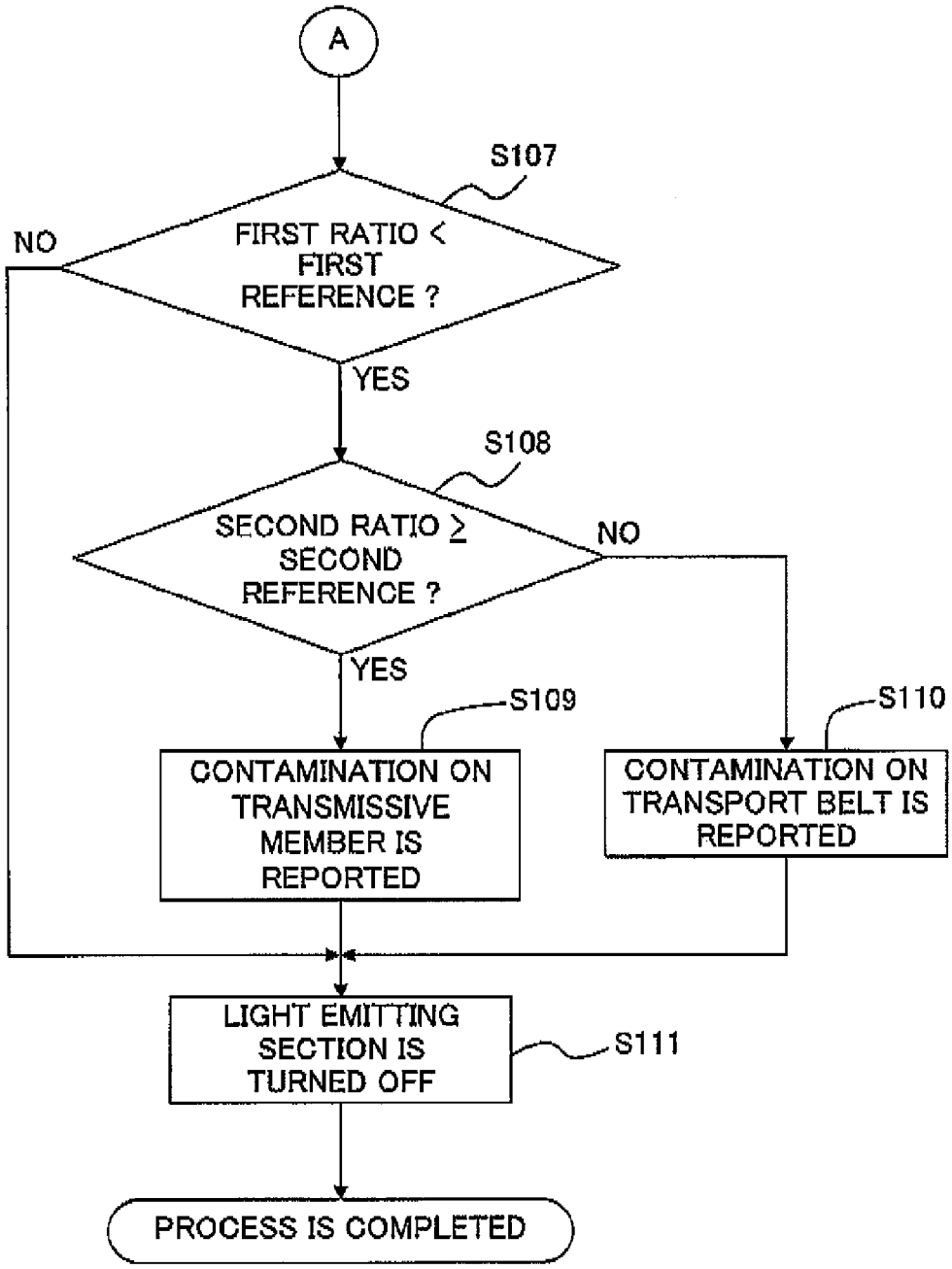

Next, an explanation will be made about the first contamination detection process for detecting as to whether or not the transmissive member 65 is contaminated, with reference to FIG. 10. The CPU 31 periodically executes the first contamination detection process when the MFP 100 is turned on.

At first, the CPU 31 judges whether there is a possibility that the transport belt 7 is contaminated by the toners other than K (toners of C, M, Y) (S101). For example, the CPU 31 judges whether or not the color printing (printing using the toners of C, M, Y) is performed after the last cleaning for the transport belt 7, by referring to the printing history stored in the NVRAM 34. This is because if the color printing is performed after the cleaning for the transport belt 7 is executed, the toners other than k (toners of C, M, Y) are more likely to adhere on the transport belt 7. When the color printing is performed after the cleaning is executed, it is judged that the transport belt 7 is contaminated by the toners other than K.

Subsequently, when it is judged that the transport belt 7 is contaminated by the toners other than K (S101: YES), it is not possible to judge which of the diffused reflection due to the contamination (toners of C, M, Y) on the transport belt 7 and the diffused reflection due to the contamination on the transmissive member 65 causes the diffused reflection light received by the diffused reflection light-receiving element 64. Thus, the cleaning for the transport belt 7 is executed to remove the contamination (toners of C, M, Y) on the transport belt 7 (S102). Then, the process proceeds to S105.

On the other hand, when the CPU judges that the transport belt 7 is not contaminated (S101: NO), S102 is not executed and the process proceeds to S105. This is because, when it is judged that the transport belt 7 is not contaminated (S101: NO), it is possible to judge that the diffused reflection light received by the diffused reflection light-receiving element 64 is not caused by the diffused reflection due to the contamination (toners of C, M, Y) on the transport belt 7, but is caused by the contamination on the transmissive member 65, without executing the cleaning for the transport belt 7. Next, the CPU 31 turns on the light-emitting element 62 to emit the light toward the transport belt 7 (S105), and then the CPU 31 measures the light amount reflected from the transport belt 7 by using the regular reflection light-receiving element 63 and the diffused reflection light-receiving element 64 (S106).

Next, the CPU 31 judges whether a quotient, which is obtained by dividing the output voltage from the regular reflection light-receiving element 63 by the PWM level, is less than the first reference (S107).

Here, the quotient, which is obtained by dividing the output voltage from the regular reflection light-receiving element 63 by the PWM level, is an example of the first ratio of the present teaching. In the first embodiment, the PWM level is fixed. Thus, when the output voltage of the regular reflection light-receiving element 63, that is, the light-receiving amount of the regular reflection light decreases, the quotient obtained by dividing the output voltage from the regular reflection light-receiving element 63 by the PWM level decreases. For example, when the PWM level is 100 and when the output voltage of the regular reflection light-receiving element 63 is changed from 4.0 V to 3.0 V, the quotient obtained by dividing the output voltage from the regular reflection light-receiving element 63 by the PWM level becomes small. In view of this, in the first embodiment, it is conveniently judged in S107 whether the output voltage from the regular reflection light-receiving element 63 is less than 3.0 V.

When the quotient obtained by dividing the output voltage from the regular reflection light-receiving element 63 by the PWM level is not less than the first reference (S107: NO), the CPU 31 turns off the light-emitting element 62 (S111) and the first contamination detection process is completed.

On the other hand, when the quotient obtained by dividing the output voltage from the regular reflection light-receiving element 63 by the PWM level is less than the first reference (S107: YES), the CPU 31 judges whether a quotient, which is obtained by dividing the output voltage from the diffused reflection light-receiving element 64 by the PWM level, is not less than the second reference (S108).

Here, the quotient, which is obtained by dividing the output voltage from the diffused reflection light-receiving element 64 (that is, the light-receiving amount of the diffused reflection light) by the PWM level, is an example of the second ratio of the present teaching. In the first embodiment, the PWM level is fixed. Thus, when the output voltage of the diffused reflection light-receiving element 64, that is, the light-receiving amount of the diffused reflection light increases, the quotient obtained by dividing the output voltage from the diffused reflection light-receiving element 64 by the PWM level increases. For example, when the PWM level is 100 and when the output voltage of the diffused reflection light-receiving element 64 is changed from 1.0 V to 2.0 V, the quotient obtained by dividing the output voltage from the diffused reflection light-receiving element 64 by the PWM level becomes large. In view of this, in the first embodiment, it is conveniently judged in S108 whether the output voltage from the diffused reflection light-receiving element 64 is not less than 2.0 V.

When the quotient obtained by dividing the output voltage from the diffused reflection light-receiving element 64 by the PWM level is not less than the second reference (S108: YES), the CPU 31 judges that the transmissive member 65 is contaminated and displays it (the transmissive member 65 is contaminated) on the operation panel 40 (S109). Then, the CPU 31 turns off the light-emitting element 62 (S111) and the first contamination detection process is completed.

On the other hand, when the quotient obtained by dividing the output voltage from the diffused reflection light-receiving element 64 by the PWM level is less than the second reference (S108: NO), the CPU 31 displays on the operation panel 40 that the transport belt 7 is contaminated (S110). Then, the CPU 31 turns off the light-emitting element 62 (S111) and the first contamination detection process is completed. Here, the distance from the diffused reflection light-receiving element 64 to the transmissive member 65 is shorter than the distance from the diffused reflection light-receiving element 64 to the transport belt 7. Therefore, the output voltage of the diffused reflection light-receiving element 64 when the transmissive member 65 has the contamination is larger than the output voltage when the transmissive member 65 has no contamination but the transport belt 7 has the contamination. In particular, although the output voltage of the diffused reflection light-receiving element 64 when the transmissive member 65 has the contamination exceeds 2.0 V, the output voltage of the diffused reflection light-receiving element 64 when the transmissive member 65 has no contamination but the transport belt 7 has the contamination never exceeds 2.0 V. Therefore, it is possible to judge whether the contamination is on the transport belt 7 or on the transmissive member 65, by judging, like S108, as to whether the output voltage of the diffused reflection light-receiving element 64 exceeds a predetermined threshold value.

Each of the first reference and the second reference may be set based on the history of the output voltage without limiting to the predetermined threshold value. Further, S105 to S108 correspond to a method for detecting the contamination of the transmissive member.

Effect of First Embodiment

As described above, according to the first embodiment, the CPU 31 judges, at first, whether the output voltage of the regular reflection light-receiving element 63 is less than 3.0 V (corresponding to S107). When the output voltage of the regular reflection light-receiving element 63 is less than 3.0 V (corresponding to "S107: YES"), the CPU 31 judges whether the output voltage of the diffused reflection light-receiving element 64 is not less than 2.0 V (corresponding to S108). When the output voltage of the diffused reflection light-receiving element 64 is not less than 2.0 V (corresponding to "S108: YES"), the transmissive member 65 is more likely to be contaminated. Thus, it is possible to judge that the transmissive member 65 is contaminated.

Further, the CPU 31 executes the cleaning for the transport belt 7 (S102) before the method for detecting the contamination of the transmissive member (S105 to S108) is executed. Thus, the judgment as to whether the transmissive member 65 is contaminated is made in the state that after the transport belt 7 is cleaned and thereby the transport belt 7 is not contaminated. Accordingly, it is possible to judge whether the transmissive member 65 is contaminated without the effect of the contamination on the transport belt 7.

Further, the CPU 31 judges whether or not the color printing is performed in the state that after the cleaning for the transport belt 7 is executed, by referring to the printing history stored in the NVRAM 34 (S101). When it is judged that the transport belt 7 is contaminated (S101: YES), the cleaning for the transport belt 7 is executed (S102). That is, when the transport belt 7 is more likely to be contaminated due to the toners of C color, M color, and Y color, judgment as to whether or not the transmissive member 65 is contaminated is not made. Accordingly, an incorrect judgment, in which the contamination on the transport belt 7 is judged as the contamination on the transmissive member 65, does not occur.

Further, when the CPU 31 judges that the transmissive member 65 is contaminated, the PCU 31 displays it (the transmissive member 65 is contaminated) on the operation panel 40 (S109). Accordingly, the user is capable of knowing that the transmissive member 65 is contaminated.

Second Embodiment

In the first embodiment, the judgment as to whether or not the transmissive member 65 is contaminated is made based on the light-receiving amounts of the reflection lights from the transport belt 7 received by the regular reflection light-receiving element 63 and the diffused reflection light-receiving element 64. In the second embodiment, the judgment as to whether or not the transmissive member 65 is contaminated is made based on the PWM level in the light-emitting amount adjustment process.

Second Contamination Detection Process

Figure 11A:
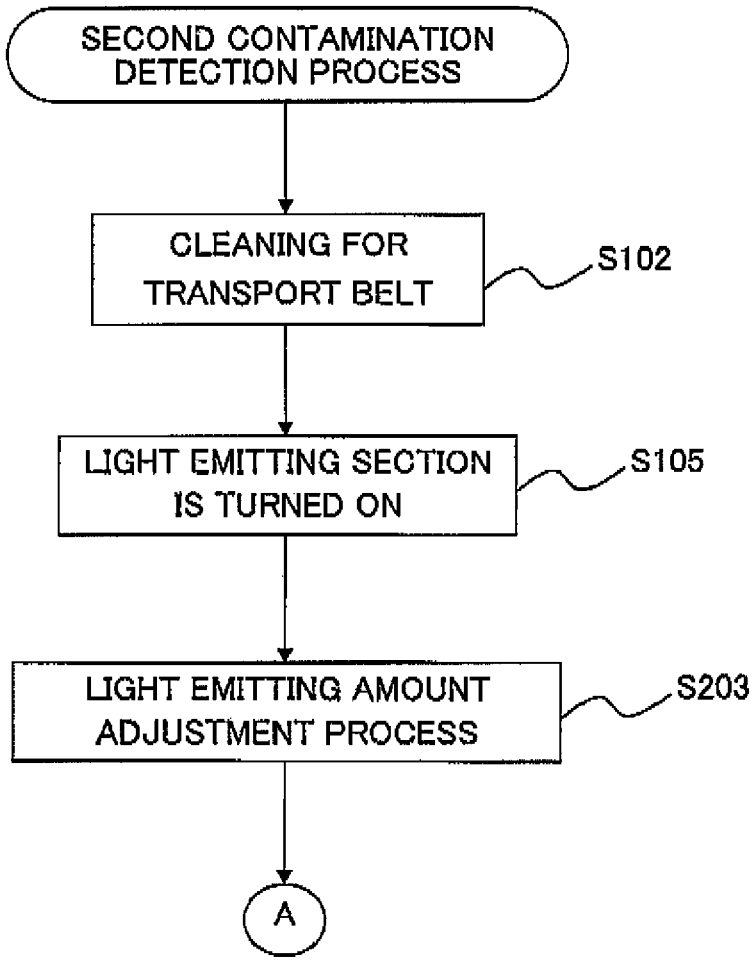
FIGS. 11A and 11B show a flowchart showing the second contamination detection process according to the second embodiment of the present teaching.
Figure 11B:
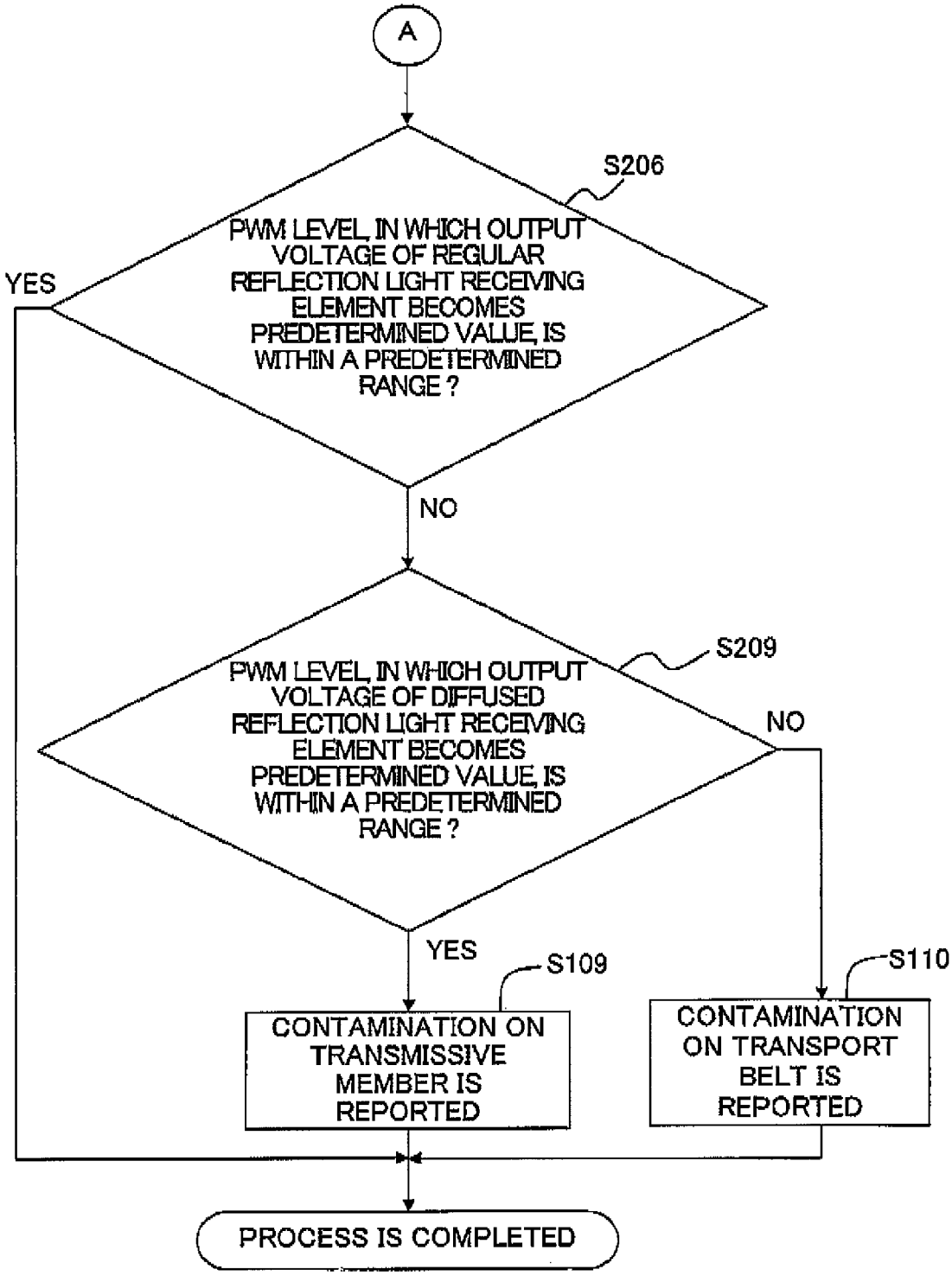

An explanation will be made about the second contamination detection process for detecting as to whether or not the transmissive member 65 is contaminated, with reference to FIG. 11. The steps which are the same as or equivalent to those of the first contamination detection process are designated by the same reference numerals (step numbers), and the description thereof is appropriately omitted. The CPU 31 periodically executes the second contamination detection process when the MFP 100 is turned on.

At first, after the CPU 31 executes the cleaning for the transport belt 7 (S102), the CPU 31 turns on the light-emitting element 62 to emit the light toward the transport belt 7 (S105). Next, the CPU 31 executes the light-emitting amount adjustment process to obtain the PWM level to be adjusted (S203).

Next, the CPU 31 judges whether a deviation of the PWM level obtained in S203, which is deviated from the durability curve L1 (see FIG. 5), is within a range of 0% to +30% (S206). It is noted that the durability curve L1 is a curve showing a relation between the cumulative number of paper sheets printed and the PWM level under the following conditions. That is, neither the transport belt 7 nor the transmissive member 65 has contamination, and even when the cumulative number of paper sheets printed increases, the PWM level is adjusted so that the output voltage of the regular reflection light-receiving element 63 becomes 4.0 V.

The relation between the cumulative number of paper sheets printed and the PWM level shown by the durability curve L1 can be previously obtained by the experimental result etc. The relation is previously stored in the NVRAM 34 as the light-emitting amount secular change table. As shown in FIG. 5, every time when the number of paper sheet printed reaches each predetermined cumulative number of paper sheets printed (N1 to N4), the CPU 31 executes the light-emitting amount adjustment process to obtain each PWM level adjusted (M1 to M4). Then, the CPU 31 judges whether or not the transmissive member 65 is contaminated by judging as to whether the deviation of the PWM level obtained in the predetermined cumulative number of paper sheets printed, which is deviated from the value of the durability curve L1 (PWM level) in said predetermined cumulative number of paper sheets printed, is within the range of 0% to +30%. For example, as shown in FIG. 5, the deviations of the adjusted PWM levels M1 to M3, which are deviated from the respective values of the durability curve L1 (PWM levels) in the predetermined cumulative numbers of paper sheets printed (N1 to N3), are within the range of 0% to +30%. However, the deviation of the adjusted PWM level M4, which is deviated from the value of the durability curve L1 (PWM level) in the predetermined cumulative number of paper sheets printed (N4), is not within the range of 0% to +30%. Thus, when the adjusted PWM level is M4 (when the cumulative number of paper sheets printed is N4), the CPU 31 judges that the transmissive member 65 is contaminated.

Here, the quotient, which is obtained by dividing the light-receiving amount of the regular reflection light (that is, the output voltage from the regular reflection light-receiving element 63) by the PWM level, is the example of the first ratio of the present teaching. In the second embodiment, the output voltage of the regular reflection light-receiving element 63 is the fixed value (4.0V). Thus, when the PWM level increases, the quotient obtained by dividing the light-receiving amount of the regular reflection light by the PWM level decreases. In view of this, in the second embodiment, it is conveniently judged in S206 whether the deviation, from the durability curve L1, of the PWM level adjusted so that the output voltage from the regular reflection light-receiving element 63 becomes 4.0V is within the range of 0% to +30%.

When it is judged that the deviation of the PWM level obtained in S203 deviated from the durability curve L1 is within the range of 0% to +30% (S206: YES), the contamination has little effect on the operation of the mark sensor 61. Thus, the CPU 31 ends the second contamination detection process.

On the other hand, when the CPU 31 judges that the deviation of the PWM level obtained in S203 deviated from the durability curve L1 is not within the range of 0% to +30% (S206: NO), the CPU 31 judges whether the deviation of the PWM level obtained in S203 deviated from the durability curve L2 (see FIG. 5) is within the range of 0% to +30% (S209). The durability curve L2 is a curve showing the relation between the cumulative number of paper sheets printed and the PWM level under the following conditions. That is, neither the transport belt 7 nor the transmissive member 65 has contamination, and even when the cumulative number of paper sheets printed increases, the PWM level is adjusted so that the output voltage of the diffused reflection light-receiving element 64 becomes 2.0 V. The relation between the cumulative number of paper sheets printed and the PWM level shown by the durability curve L2 can also be specified by the experimental result etc. The relation is previously stored in the NVRAM 34 as the light-emitting amount secular change table. It is noted that S203 to S209 correspond to the method for detecting the contamination on the transmissive member 65.

Here, the quotient, which is obtained by dividing the light-receiving amount of the diffused reflection light (that is, the output voltage from the diffused reflection light-receiving element 64) by the PWM level, is the example of the second ratio of the present teaching. In the second embodiment, the output voltage of the diffused reflection light-receiving element 64 is the fixed value (2.0V). Thus, when the PWM level increases, the quotient obtained by dividing the light-receiving amount of the diffused reflection light by the PWM level decreases. In view of this, in the second embodiment, it is conveniently judged in S209 whether the deviation, from the durability curve L2, of the PWM level, which is adjusted so that the output voltage from the diffused reflection light-receiving element 64 becomes 2.0V, is within the range of 0% to +30%.

When it is judged that the deviation of the PWM level obtained in S203 deviated from the durability curve L2 is within the range of 0% to +30% (S209: YES), the CPU 31 judges that the transmissive member 65 is contaminated. Then, the CPU 31 displays on the operation panel 40 that the transmissive member 65 is contaminated (S109), and the second contamination detection process is completed.

On the other hand, when the CPU 31 judges that the deviation of the PWM level obtained in S203 deviated from the durability curve L2 is not within the range of 0% to +30% (the deviation is +30% or more) (S209: NO), the CPU 31 judges that the transport belt 7 is contaminated. Then, the CPU 31 displays on the operation panel 40 that the transport belt 7 is contaminated (S110), and the second contamination detection process is completed.

Effect of Second Embodiment

As described above, according to the second embodiment, the CPU 31 executes the light-emitting amount adjustment process (S203) to judge whether the deviation of the PWM level obtained in S203 deviated from the durability curve L1 is within the range of 0% to +30% (S206). When it is judged that the deviation of said PWM level deviated from the durability curve L1 is not within the range of 0% to +30% (S206: NO), the CPU 31 judges whether the deviation of said PWM level deviated from the durability curve L2 is within the range of 0% to +30% (S209). When the deviation of said PWM level deviated from the durability curve L2 is within the range of 0% to +30% (S209: YES), the CPU 31 judges that the transmissive member 65 is contaminated.

The CPU 31 executes the light-emitting amount adjustment process (S203) after the cleaning for the transport belt 7 (S102) is executed. The judgment as to whether or not the transmissive member 65 is contaminated is made in the state that after the transport belt 7 is cleaned and thereby the transport belt 7 is not contaminated. Thus, it is possible to judge whether or not the transmissive member 65 is contaminated without the effect of the contamination on the transport belt 7.

When the CPU 31 executes the light-emitting amount adjustment process (S203), when the CPU 31 judges that the deviation of the PWM level deviated from the durability curve L1 is not within the range of 0% to +30% (S206: NO), and when the CPU 31 judges that the deviation of said PWM level deviated from the durability curve L2 is within the range of 0% to +30% (S209: YES), the CPU 31 judges that the transmissive member 65 is contaminated. Thus, the CPU 31 judges whether the transmissive member 65 is contaminated while considering the change of condition of the transport belt 7 depending on the period of use of the transport belt 7. Therefore, an incorrect judgment, in which the change of the condition of the transport belt 7 depending on the period of use of the transport belt 7 is judged as the contamination on the transmissive member 65, does not occur.

When the CPU 31 judges that the transmissive member 65 is contaminated, the CPU 31 displays on the operation panel 40 that the transmissive member 65 is contaminated (S109). Thus, the user is capable of knowing that the transmissive member 65 is contaminated.

Third Embodiment

Figure 12A:
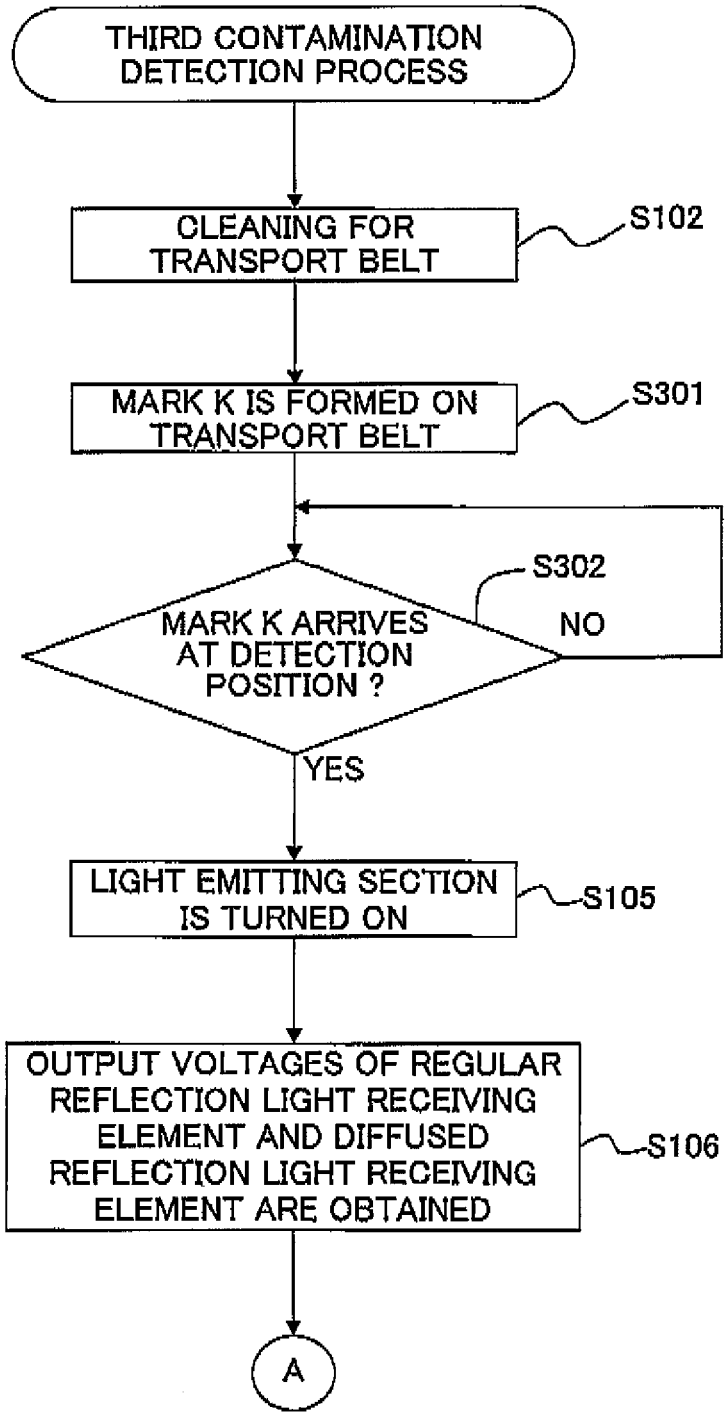
FIGS. 12A and 12B show a flowchart showing the third contamination detection process according to the third embodiment of the present teaching.
Figure 12B:
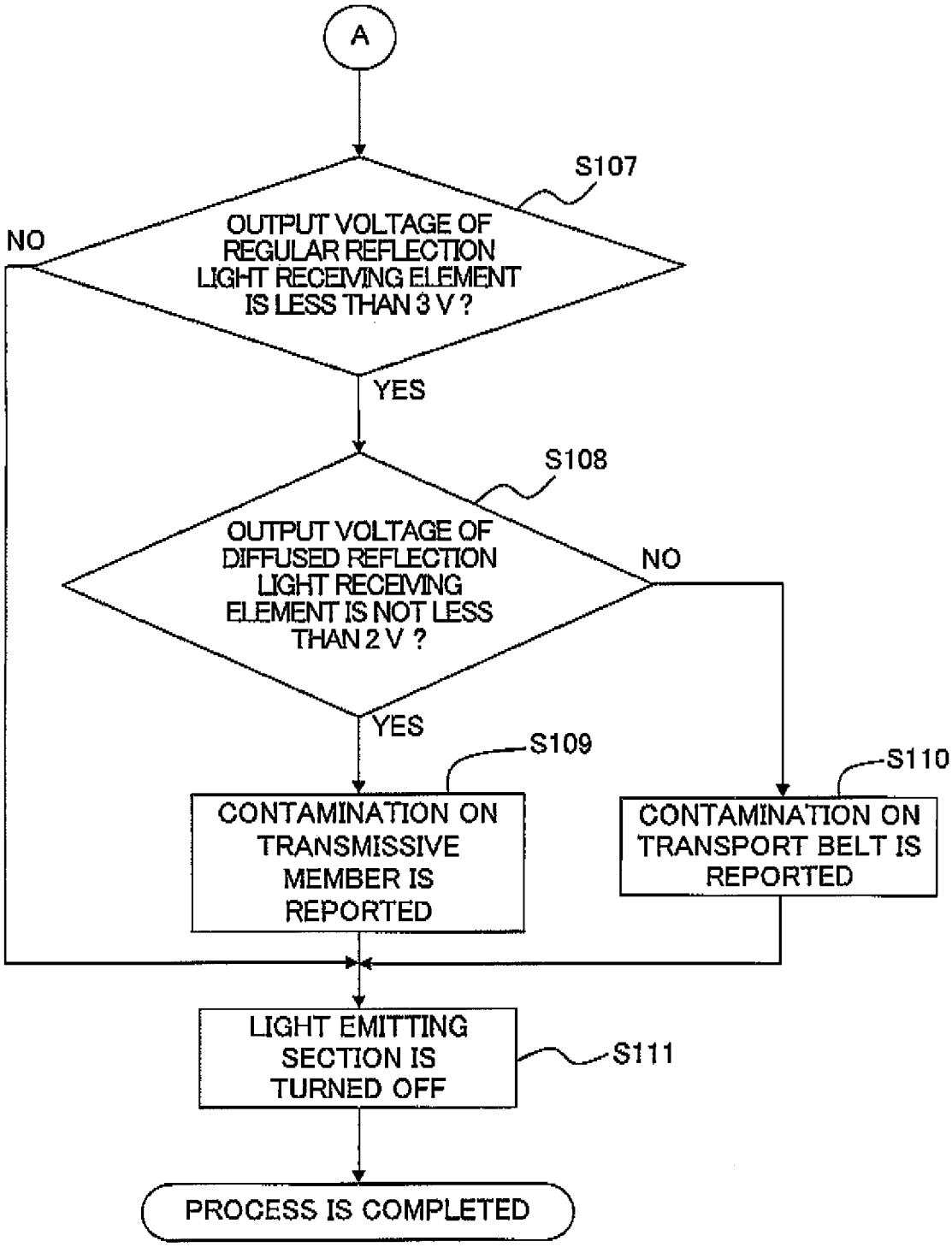

An explanation will be made about the third contamination detection process for detecting as to whether or not the transmissive member 65 is contaminated, with reference to FIG. 12. The steps which are the same as or equivalent to those of the first and second contamination detection processes are designated by the same reference numerals (step numbers), and the description thereof is appropriately omitted. The CPU 31 periodically executes the third contamination detection process when the MFP 100 is turned on.

At first, the CPU 31 forms a mark 66K on the transport belt 7 by the image forming section 10 (S301) after the cleaning for the transport belt 7 is executed (S102). Subsequently, the CPU 31 judges whether or not the mark 66K arrives at the dotted frame E shown in FIG. 4 (S302).

When the mark 66K does not arrive at the dotted frame E (S302: NO), the CPU 31 waits until the mark 66K arrives at the dotted frame E. On the other hand, when the mark 66K arrives at the dotted frame E (S302: YES), the CPU 31 turns on the light-emitting element 62 to emit the light toward the transport belt 7 (S105). The processes subsequent to S106 are similar to those of the first contamination detection process.

Here, as described above, the mark 66K has the property to absorb the light emitted from the light-emitting element 62. Thus, even if the light-emitting element 62 is turned on to emit the light toward the transport belt 7 in the case that the mark 66K arrives at the dotted frame E, the regular reflection light-receiving element 63 hardly receives the regular reflection light from the transport belt 7 and the diffused reflection light-receiving element 64 hardly receives the diffused reflection light from the transport belt 7.

Further, a member provided between the light-emitting element 62 and the transport belt 7 is the transmissive member 65 only. Accordingly, when the mark 66K arrives at the dotted frame E and when each of the regular reflection light-receiving element 63 and the diffused reflection light-receiving element 64 receives the reflect light by turning on the light-emitting element 62, it is possible to assume that the transmissive member 65 has any cause for the reflection of the light from the light-emitting element 62.

Further, the distance from the light-emitting element 62 to the transmissive member 65 is shorter than the distance from the light-emitting element 62 to the transport belt 7. Therefore, it is possible to assume that the output voltage from the regular reflection light-receiving element 63 and the output voltage from the diffused reflection light-receiving element 64, each of which is obtained when the toner adhered on the transmissive member 65 reflects the light emitted from the light-emitting element 62, are higher, as compared with a case in which the transport belt 7 reflects the light from the light-emitting element 62.

In view of this, this embodiment also focuses on the diffused reflection light as in the first and second embodiments. When the output voltage from the diffused reflection light-receiving element 64 is high (S108: YES), the toner adhered on the transmissive member 65 is regarded as to reflect the light emitted from the light-emitting element 62, and it is judged that the transmissive member 65 is contaminated.

Effect of Third Embodiment

As described above, according to the third embodiment, when the mark 66K arrives at the dotted frame E (S302: YES), the CPU 31 turns on the light-emitting element 62 to emit the light toward the transport belt 7 (S105). In this case, it is possible to reduce the effects of the regular reflection light and the diffused reflection light from the transport belt 7. Accordingly, it is possible to accurately judge whether or not the transmissive member 65 is contaminated.

Other Embodiment

In the first, second, and third embodiments, the MFP 100 includes the image forming section 10 in which the exposure is performed by the laser. However, the MFP 100 may include an image forming section in which the exposure is performed by LED.

In the first, second, and third embodiments, the MFP 100 includes the image forming section 10 of a direct tandem type. However, the MFP 100 may include the image forming section 10 of an intermediate transfer-type. In this case, the present teaching may be applied to an intermediate transfer belt transporting the mark, instead of the transport belt 7 transporting the paper sheet.

In the first and second embodiments, it is configured as follows. That is, each of the light-emitting element 62, the regular reflection light-receiving element 63, and the diffused reflection light-receiving element 64 is disposed at the position facing the transport belt 7, and the transmissive member 65 is disposed between the transport belt 7 and each of the light-emitting element 62, the regular reflection light-receiving element 63, and the diffused reflection light-receiving element 64. However, the following configuration is allowable. That is, each of the light-emitting element, the regular reflection light-receiving element, and the diffused reflection light-receiving element is disposed at the position facing the photosensitive member 1, and the transmissive member is disposed between the photosensitive member 1 and each of the light-emitting element, the regular reflection light-receiving element, and the diffused reflection light-receiving element. In this case, it is possible to detect whether or not the transmissive member 65 provided at the position facing the photosensitive member 1 is contaminated.

The second embodiment is an embodiment in which, when the CPU 31 judges that the deviation of the value of the PWM level deviated from the value of the durability curve L1 is not within the range of 0% to +30% (S206: NO), the CPU 31 judges whether the deviation of the value of said PWM level deviated from the value of the durability curve L2 is within the range of 0% to +30% (S209). However, other embodiments are allowable.

For example, the following judgment is allowable. That is, when the CPU 31 judges that the deviation of the value of the PWM level deviated from the value of the durability curve L1 is not within the range of 0% to +30% (S206: NO), the CPU 31 judges in the light-emitting amount adjustment process (S203) whether the PWM level exceeds a maladjustment threshold (the value of which is 180) at which the maladjustment is caused. Then, when the PWM level exceeds the maladjustment threshold, the CPU 31 judges that the transmissive member 65 is contaminated by the toner of K color. When the PWM level does not exceed the maladjustment threshold, the CPU 31 judges that the transmissive member 65 is contaminated by the toners of C color, M color, and Y color.

In the first, second, and third embodiments, it is judged whether or not the transmissive member 65 is contaminated by using the output voltage of the regular reflection light-receiving element 63, the output voltage of the diffused reflection light-receiving element 64, and the predetermined threshold value. However, the predetermined threshold value may be a threshold value deriving from the history of the output voltage without limiting to the predetermined threshold value. For example, when the light-receiving amounts of the regular reflection light and the diffused reflection light which are received this time are deviated from the histories of the light-receiving amounts of the regular reflection light and the diffused reflection light (each of which is an example of a first reference and a second reference of the present teaching), the transmissive member 65 may be judged to have the contamination. However, even when the transmissive member 65 is gradually contaminated, it is possible to more reliably judge whether the transmissive member 65 is contaminated in the case that the light-receiving amounts of the regular reflection light and the diffused reflection light are judged based on the predetermined threshold values as described in the first, second, and third embodiments, as compared with the case in which the light-receiving amounts of the regular reflection light and the diffused reflection light are judged based on the histories of the light-receiving amounts of the regular reflection light and the diffused reflection light.

In the first, second, and third embodiments, as for the ratio of the light-receiving amount of the regular reflection light-receiving element 63 to the PWM level, any one of the PWM level and the light-receiving amount of the regular reflection light-receiving element 63 is fixed. However, it is allowable that both the PWM level and the light-receiving amount of the regular reflection light-receiving element 63 are variable.

In the above description, the first, second, and third embodiments have been described in detail with reference to the drawings, these are provided merely as examples. The present teaching can be carried out in any other embodiment in which various changes and modifications are made based on the knowledge of the persons skilled in the art.

What is claimed is:

1. A printing apparatus which prints an image on a recording medium, comprising:

an image forming section which forms a toner image of the image to be printed on the recording medium;

a transport belt which transports the toner image formed by the image forming section;

a light-emitting section which emits a light to the transport belt;

a first light-receiving section which is disposed at a position through which a regular reflection light, of the light emitted from the light-emitting section, reflected from the transport belt passes;

a second light-receiving section which is disposed at a position different from the position of the first light-receiving section;

a transmissive member which is disposed at a position through which the light emitted from the light-emitting section to the transport belt and a reflection light, of the light, reflected from the transport belt pass and which transmits the light and the reflection light; and a judgment section which calculates a first ratio which is a ratio of a light-receiving amount of the first light-receiving section to a light-emitting amount of the light-emitting section and a second ratio which is a ratio of a light-receiving amount of the second light-receiving section to the light-emitting amount of the light-emitting section, and the judgment section judges whether or not the transmissive member is contaminated based on the first ratio and the second ratio.

2. The printing apparatus according to claim 1, wherein, in a case that the first ratio is smaller than a first reference and that the second ratio is not smaller than a second reference which is smaller than the first reference, the judgment section judges that the transmissive member is contaminated.

3. The printing apparatus according to claim 2, wherein, when the image forming section forms, on the transport belt, a mark which absorbs the light emitted from the light-emitting section and the light-emitting section emits the light to the mark formed on the transport belt, in a case that the first ratio is smaller than the first reference and the second ratio is not smaller than the second reference, the judgment section judges that the transmissive member is contaminated.

4. The printing apparatus according to claim 2, further comprising a cleaning section which cleans the transport belt, wherein after the cleaning section cleans the transport belt, in a case that the first ratio is smaller than the first reference and the second ratio is not smaller than the second reference, the judgment section judges that the transmissive member is contaminated.

5. The printing apparatus according to claim 4, wherein after the image forming section forms the image on the recording medium by using toners of a plurality of colors and before the cleaning section cleans the transport belt, the judgment section does not judge whether the transmissive member is contaminated.

6. The printing apparatus according to claim 1, further comprising an adjustment section which adjusts the light-emitting amount of the light-emitting section based on a period of use of the transport belt, wherein the judgment section calculates the first ratio and the second ratio based on the light-emitting amount of the light-emitting section adjusted by the adjustment section.

7. The printing apparatus according to claim 1, further comprising a reporting section which reports that the transmissive member is contaminated in a case that the judgment section judges that the transmissive member is contaminated.

8. The printing apparatus according to claim 1, wherein the judgment section calculates the first ratio and the second ratio under a condition that the light-emitting amount of the light-emitting section is a fixed value.

9. The printing apparatus according to claim 1, wherein the judgment section calculates the first ratio and the second ratio under a condition that the light-receiving amount of the first light-receiving section and the light-receiving amount of the second light-receiving section are fixed values.

10. The printing apparatus according to claim 1, wherein the transport belt transports the recording medium on which the toner image is formed by the image forming section.

* * * * *